United States Patent [19]

Parsons et al.

[11] 4,243,832

[45] Jan. 6, 1981

[54] ELECTRIC ARC FURNACES

[75] Inventors: Charles H. Parsons, Benoni; Badenhorst H. Casper, Verwoerd Park Extension 3, both of South Africa

[73] Assignee: Infurnco (Proprietary) Limited, Transvaal, South Africa

[21] Appl. No.: 18,799

[22] Filed: Mar. 8, 1979

[30] Foreign Application Priority Data

Mar. 9, 1978 [ZA] South Africa ..... 78/1382

[51] Int. Cl.[3] ..... H05B 7/1 01

[52] U.S. Cl. ..... 13/16

[58] Field of Search ..... 13/13, 14, 15, 16, 17, 13/18 C

[56] References Cited

U.S. PATENT DOCUMENTS

| | | | |
|---|---|---|---|
| 2,297,484 | 9/1942 | Lehrer et al. | 13/16 X |
| 2,668,183 | 2/1954 | Foyn | 13/16 |
| 3,107,267 | 10/1963 | Blackmore | 13/16 |
| 3,898,364 | 8/1975 | Hardin | 13/14 |

*Primary Examiner*—Roy N. Envall, Jr.
*Attorney, Agent, or Firm*—Merchant, Gould, Smith, Edell, Welter & Schmidt

[57] ABSTRACT

The invention relates to electrode support gear utilized with electric arc furnaces incorporating consumable electrodes. The support gear incorporates two sets of clamps for the electrode, one of which is spring biased to hold the electrode against movement under gravity, and the other which is power operated and can be used to slip the electrode to and fro in relation to the first set of clamps. The arrangement achieves a saving in capital costs in that only one set of clamps is power operated and safety is achieved in that the spring biased clamps constantly grip the electrode. An additional safety feature may be provided by springs on the power operative clamps which operate to clamp the electrode in the event of a power failure.

5 Claims, 3 Drawing Figures

ELECTRIC ARC FURNACES

The invention relates to electrode support gear utilized with electric arc furnaces of the kind employing consumable electrodes.

As the electrode is consumed it must be advanced, at least intermittently, so that the arc is maintained. It is also desirable for the electrode support gear to be capable of retracting the electrode in case of breakdowns when it may be desirable to clear the furnace without totally dismantling the electrode.

The support gear in one arrangement incorporates two groups of clamps or girdles operated by power cylinders in tandem to advance or retract the electrode. This arrangement is effective but costly in that power means is required for each group of girdles. Furthermore the arrangement is subject to the danger of damage should the power supply to the operating group of girdles fail.

It is an object of the invention to provide electrode advance and retraction gear in which the above disadvantages are at least minimised.

According to the invention electrode support gear for an electric arc furnace incorporating a consumable electrode includes frame support means, first clamping means mounted on the frame support and incorporating springs biasing the clamping means into clamping association with the electrode whereby the electrode is supported against movement under gravity, power operated second clamping means movable into or out of clamping association with the electrode, and a power operated lever arm also mounted on the frame support and adapted for raising and lowering the said second clamping means, the power operated lever and second clamping means being operable in a first sequence to effect electrode advance and in a second sequence to effect electrode retraction by slipping the electrode in relation to the first clamping means.

Thus in the electrode advance sequence power is fed to the second clamping means to clamp the electrode when the lever is raised. The arrangement is such that the clamping force exerted by the second clamping means is greater than that exerted by the first clamping means. Thereafter power is fed to the lever to lower the second clamp thus advancing the electrode which slips through the first clamping means. When the second clamp is at its lower position, power to the second clamp is reversed to open the clamp whereafter power is fed to the lever to raise the second clamp which slides without causing movement of the electrode so that the cycle may then be repeated for effecting further advance of the electrode if and when necessary. Electrode retraction is effected in reverse sequence as is described below.

Further, according to the invention, the power operated second clamping means is also equipped with spring means biasing the clamp into clamping association with the electrode. The operation of the springs is overcome by action of the power means to open the clamp but the clamp is biased to a "fail safe" condition in the event of failure of power to the second clamp.

Preferably each clamping means includes a plurality of girdle clamp members each served with its own spring and/or power means as the case may be. Preferably also the power operating means comprises hydraulic or pneumatic piston and cylinder assemblies.

In order to illustrate the invention an example will now be described with reference to the accompanying drawings in which:

FIG. 3 is a plan view taken on the line III—III in FIG. 1.

Figure 1:
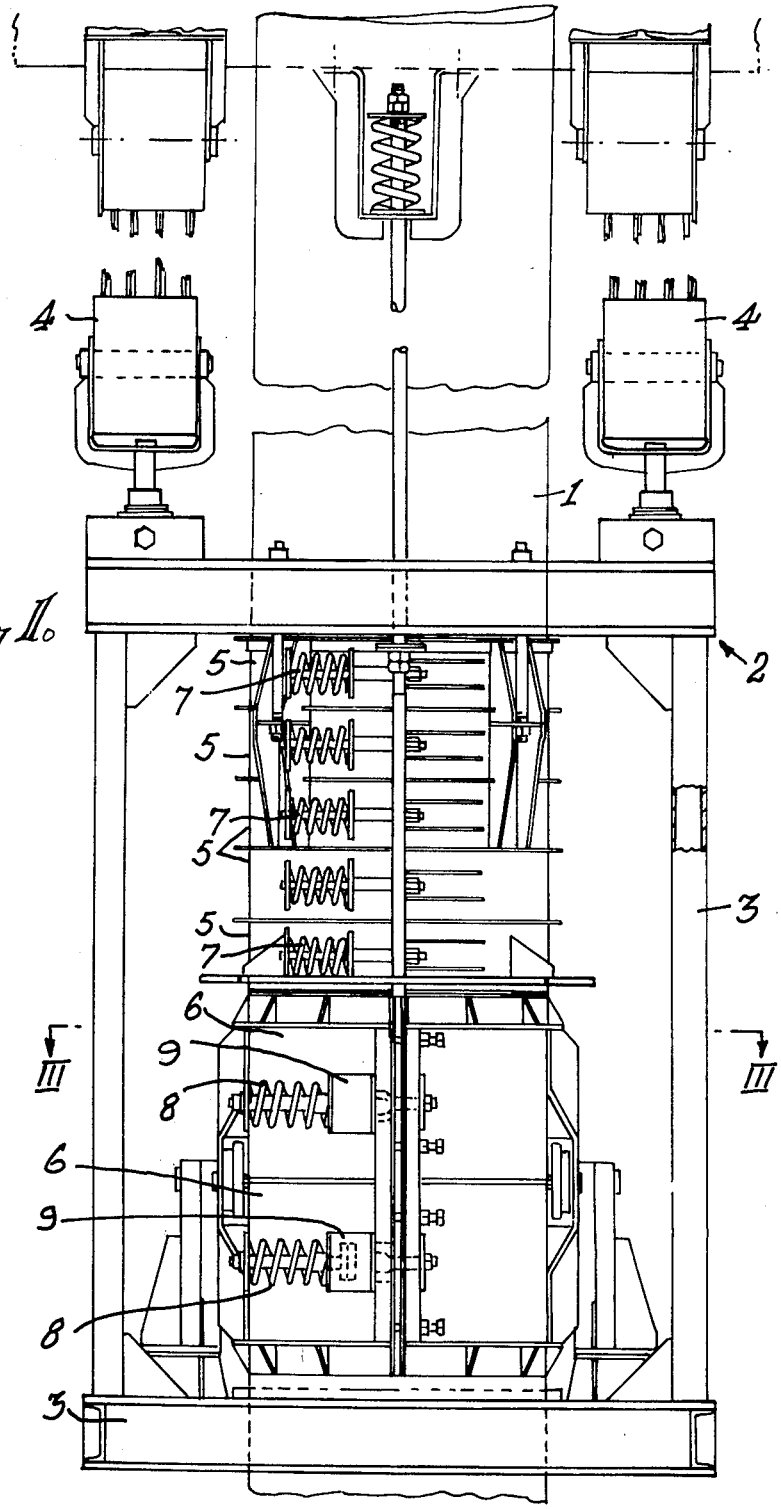
FIG. 1 is a side elevation of an electrode support gear according to the invention.

Referring to the drawings, a consumable electrode 1 for an electric arc furnace (not shown) is supported by electrode support gear indicated generally by reference 2.

Such support gear incorporates a support frame 3, mounted on a pulley system 4 which is capable of raising the entire electrode support gear 2 and the electrode 1 to a limited extent. The purpose of the pulley system is for raising the entire electrode support gear 1 in the normal course of operation of the furnace.

Two sets of girdle clamps 5 and 6 respectively are provided for the electrode, clamps 5 being mounted on the frame 3 and biased into clamping association with the electrode under constant force by compression springs 7. The clamping effect of the clamps 5 is sufficient to support the electrode 1 against movement under gravity.

The clamps 6 are also biased by springs 8 into clamping association with the electrode 1 but in addition, the clamps 6 are served by double acting rams 9 operative either to force the clamps into closure under assistance of the springs 8 or to open the clamps 6 against the action of the springs 8.

Figure 2:
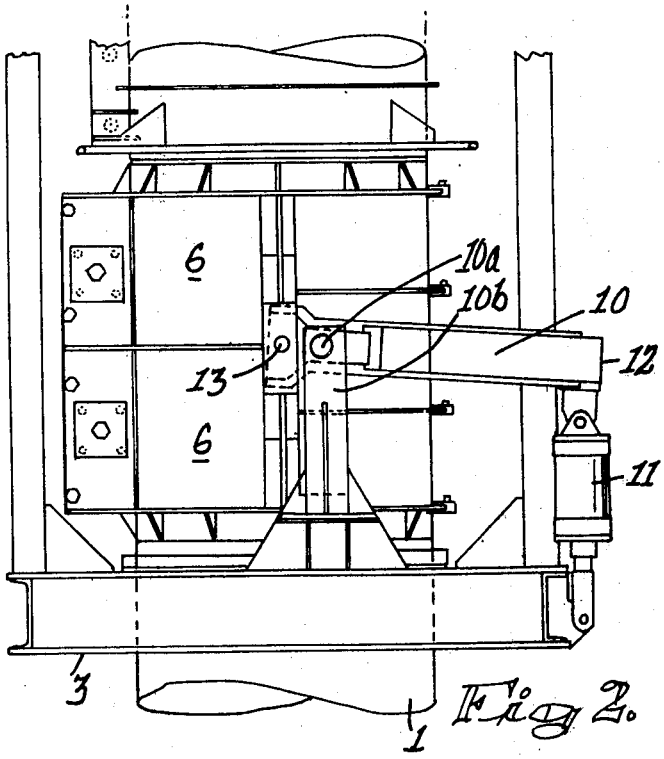
FIG. 2 is a side elevation of a further portion of the electrode support gear.
Figure 5:
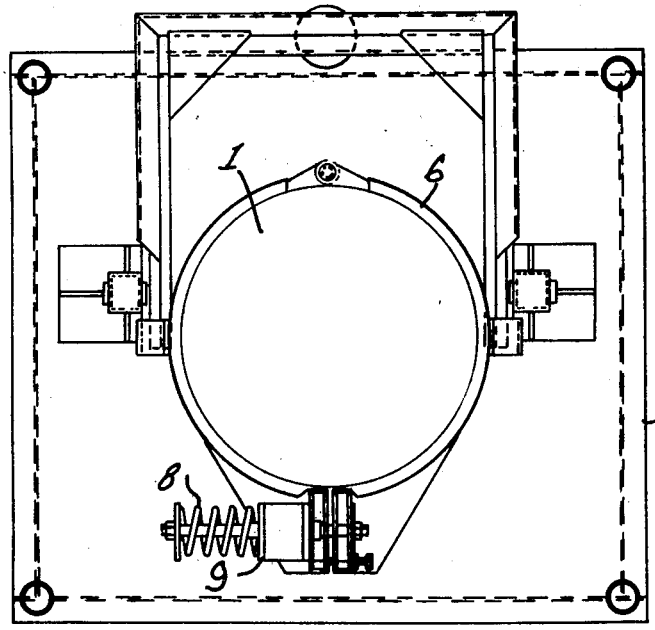

As may be seen in FIG. 2, the support gear is also equipped with a lever arm 10 pivotally mounted at **10*a* on a support 10*b* secured to the frame 3. The lever arm 10 is served by a double acting ram 11 which is also mounted on the frame 3. One end of the lever arm 10 is coupled to the clamps 6 while the other end is coupled to the ram 11 so that extension of the ram causes lowering of the clamps 6 and contraction of the ram 11** causes raising of the clamps.

The rams 9 and 11 are operated in first and second sequence relationships. In the first sequence hydraulic or pneumatic fluid is fed to the rams in order to provide an electrode advance cycle. Thus when the electrode advance cycle is commenced, power is initially fed to the rams 9 to cause clamping of the electrode 1 by clamps 6. Whereafter power is fed to the ram 11 to extend it and thus to raise end 12 of the lever arm 10 and lower its end 13 together with the clamps 6 causing the electrode 1 to advance into the furnace. During the advance cycle the electrode is forwardly slipped through the clamps 5 against the friction action afforded by these clamps.

When clamps 6 have been moved to the forward end of their range of travel, a distance of 2 to 3 centimeters, power to the rams 9 is reversed causing clamps 6 to open against the action of springs 8 whereafter power to the ram 11 is reversed to contact it and thus to raise the clamps to the other end of their range of travel. Thereafter the first sequence operation of rams 9 and 11 may be repeated to effect further advance of the electrode 1.

During the open condition of clamp 6, the electrode 1 is held against movement under gravity by clamps 5.

In the second sequence operation of the rams 9 and 11, retraction or backslipping of the electrode 1 is effected. In this retraction the cycle is merely reversed in that power is first fed to the rams 9 to cause release of the electrode 1 by clamps 6. Thereafter power is fed to the ram 11 to extend it thereby raising end 12 of lever arm 10 and lowering its end 13 together with the clamp 6 which slip relative to the electrode 1 to the forward end of the range of travel of the clamps. Power to the rams 9 is then reversed causing the clamps 6 to close and grip the electrode 1, whereafter power to the ram 11 is reversed to contract it and thus to raise the clamp 6 causing the electrode 1 to retract from the furnace backslipping in relation to the clamps 5.

Further backslipping may be effected by repeating a second sequence operation of rams 9 and 11.

It will be appreciated that in the above arrangement a fail safe system is provided in that the clamps 5 are constantly biased to a condition to which they are able to support the electrode 1. Furthermore, should power to the rams 9 fail, the springs 8 bias the clamps 6 to a condition clamping the electrode. Since only the clamps 6 are served with power operated means in the form of rams, the electrode supporting gear is relatively inexpensive and is capable not only of advancing the electrode but also of backslipping it as the necessity arises.

Many examples of the invention exist which differ in matters of detail only from the above example. The essence of the invention resides in the use of two sets of clamps one of which is spring biased to hold the electrode against movement under gravity and the other of which is power operated and can be used to slip the electrode to and fro in relation to the first set of clamps.

We claim:

1. Electrode support gear for an electric arc furnace incorporating a consumable electrode including frame support means, first clamping means mounted on the frame support and incorporating springs biasing the clamping means into clamping association with the electrode whereby the electrode is supported against movement under gravity, power operated second clamping means movable into or out of clamping association with the electrode, and a power operated lever arm also mounted on the frame support and adapted for raising and lowering the said second clamping means, the power operated lever and second clamping means being operable in a first sequence to effect electrode advance and in a second sequence to effect electrode retraction by slipping the electrode in relation to the first clamping means.

2. The electrode support gear of claim 1 in which the power operated second clamping means is also equipped with spring means biasing the clamp into clamping association with the electrode.

3. The electrode support gear of claim 1 in which each clamping means includes a plurality of girdle clamp members each served with its own power means.

4. The electrode support gear of claim 1 in which the power operating means comprise hydraulic or pneumatic piston and cylinder assemblies.

5. The electrode support gear of claim 1 in which each clamping means includes a plurality of girdle clamp members each served with its own spring.

* * * * *